US005505141A

United States Patent [19]

Barber

[11] Patent Number: 5,505,141

[45] Date of Patent: Apr. 9, 1996

[54] PLASTIC PALLET

[76] Inventor: Roy W. Barber, 210 Ponderosa Rd., Winnsboro, La. 71295

[21] Appl. No.: 394,271

[22] Filed: Feb. 24, 1995

[51] Int. Cl.[6] ..... B65D 19/00

[52] U.S. Cl. ..... 108/51.1; 108/901; 108/56.1

[58] Field of Search ..... 108/51.1, 55.5, 108/56.1, 901, 57.1, 53.1

[56] References Cited

U.S. PATENT DOCUMENTS

| | | | |
|---|---|---|---|
| D. 347,511 | 5/1994 | Piggott et al. . | |
| 3,199,469 | 8/1965 | Sullivan . | |
| 3,301,200 | 1/1967 | Landsieel et al. | 108/56.1 |
| 3,526,195 | 9/1970 | Maryonovich | 108/53.1 |
| 3,667,403 | 6/1972 | Angelbeck, Jr. | 108/51.1 |
| 3,677,200 | 7/1972 | Coccagna et al. | 108/901 X |
| 3,680,496 | 8/1972 | Westlake, Jr. . | |
| 3,757,704 | 9/1973 | Allgeyer et al. . | |
| 3,835,792 | 9/1974 | Wharton | 108/56.1 |
| 3,938,448 | 2/1976 | Nishitani et al. . | |
| 3,954,067 | 5/1976 | Miles | 108/57.1 |
| 4,000,704 | 1/1977 | Griffin, Jr. | 108/901 X |
| 4,189,125 | 2/1980 | Little | 108/901 X |
| 4,413,737 | 11/1983 | Wind | 108/53.1 X |
| 5,007,352 | 4/1991 | Calkoen | 108/56.1 |
| 5,197,396 | 3/1993 | Breezer et al. . | |
| 5,329,862 | 7/1994 | Breezer et al. | 108/55.5 |

*Primary Examiner*—Laurie K. Cranmer
*Assistant Examiner*—Janet M. Wilkens
*Attorney, Agent, or Firm*—Richard C. Litman

[57] ABSTRACT

A plastic pallet is formed of two identical interlocking and mating components joined along a common center plane. At least one internal component is stepped, with the steps of two components fitting together to interlock the two components together when they are assembled. The two components include integrally formed plural spaced apart deck boards, tiedown passages, and fork lift slots or passages in each of the four sides of the rectangular assembly. A generally rectangular peripheral structure and a cruciform central structure are provided for additional reinforcement. The two halves are bolted together for use, with an assembled pallet being easily disassembled to remove a damaged component for replacement. As the two components comprising the present pallet are identical, they may be cast or formed in a single mold, or in identical molds, with any half pallet component serving as a replacement. The components are preferably formed of thermoplastic material which may be recycled if damaged or otherwise rendered unsuitable for further use.

20 Claims, 3 Drawing Sheets

PLASTIC PALLET

FIELD OF THE INVENTION

The present invention relates generally to shipping pallets and the like used in the transport and storage of various articles, and more specifically to a plastic pallet formed in two identical and interlocking halves. The identical components provide for mating units to be formed in a single mold or identical molds, and enable a damaged section to be replaced by any other component without need to consider distinctions between different components.

BACKGROUND OF THE INVENTION

Standardized shipping pallets are in great demand in the manufacturing and transportation industries, as more and more products are shipped and stored in bulk via ground or air transportation. One common link between virtually all forms of transportation and storage for such articles, is the need at some point to move the articles by fork lift. The development of the shipping pallet, with means providing for the securing of cargo or goods thereto and for lifting the pallet using the tines of a fork lift, has greatly facilitated the shipment and storage of such articles and goods.

Most such shipping pallets are constructed of wood. However, relatively low quality wood is typically used, and such pallets are rapidly rough cut and assembled to save labor costs. Thus, they are prone to rapid deterioration and breakage, and frequent replacement is required. Moreover, the rough nature of the material often results in splinters and other minor injuries to persons handling the pallets, occasionally resulting in infections due to the often less than ideal sanitary conditions of the typical environment of such pallets. The wood material does not lend itself to the formation of mating components without relatively complex construction (and the time required for such), thus resulting in the need to scrap the entire pallet if a single portion is damaged to any great extent. While wood may be a renewable resource, ideally the pallet material itself would be recyclable, rather than being burned or thrown away in a land fill, as is often the case with wood.

As a result, other materials such as fiberboard and plastic, have been used to construct pallets. Fiberboard may be recyclable, but its wood like nature, requiring cutting and assembly, again precludes economical construction of a pallet of mating components to allow a single component to be scrapped in the event of damage; such fiberboard pallets typically are short lived, subject to moisture damage, and must be scrapped in their entirety if a single portion is damaged to any great extent.

Thus, plastic has been used as a response to these problems. Earlier plastic pallets may respond to the need for durability and recyclability, but must still be scrapped if significant damage occurs to a single portion thereof. Plastic pallets constructed of multiple components are of some assistance in this regard, but the problem then arises of differently configured pallet portions, with only the properly configured portions capable of being assembled with one another. Thus, at least some pallet sections of each configuration must be kept on hand, and the possibility exists of the wrong component being supplied for repair, and the resulting time loss waiting for the error to be corrected.

The need arises for pallets formed of cast or molded plastic materials which pallets are assembled from two identical interlocking, mating sections. Thus, damage to a single section may be easily cured by removing the damaged section and replacing it with any other section of any other like pallet, since all sections are identical. The interlocking of the two portions of the present pallet ensures that they will not slip relative to one another when secured together, thus reducing shear stresses on the bolts securing the two halves together and also reducing the likelihood of the bolts being loosened due to movement between the two halves. The material is less likely to cause injury to persons handling it than other materials, and is also generally more durable than other materials used for pallet construction. If damage occurs to such a pallet, the damaged component may be recycled for further use.

DESCRIPTION OF THE PRIOR ART

U.S. Pat. No. 3,199,469 issued to Charles M. Sullivan on Aug. 10, 1965 describes a Pallet Structure comprising a single sheet of plastic material. No identical interlocking components are used to form the pallet, although multiple pallets may be nested when stacked together for storage. No substructure providing additional strength is disclosed by Sullivan, although the use of permanently imbedded steel skid shoes is indicated. The present pallet sections are devoid of any materials other than the plastic from which they are cast or molded. Steel bolts are used to assemble the present components, but such bolts are removable and are not an integral part of the pallet components. Sullivan's pallets are generally unbroken sheets of material.

U.S. Pat. No. 3,680,496 issued to Edward B. Westlake, Jr. on Aug. 1, 1972 describes a Plastic Pallet formed of permanently Assembled upper and lower portions. In some embodiments, identical upper and lower components are shown, but they do not interlock, while the interlocking components are not identical to one another. The top and bottom sheets are unbroken, as in the Sullivan pallet discussed above.

U.S. Pat. No. 3,757,704 issued to Guy H. Allgeyer et. al. on Sep. 11, 1973 describes a Pallet formed of several components permanently bonded or secured together. Some of the components appear Co interlock, but cannot be disassembled and are not identical to one another. As in the case of the Sullivan and Westlake, Jr. patents discussed above, the pallet is generally unbroken and devoid of any passages therethrough. The present pallet components include plural elongate deck boards integrally formed thereon, with gaps therebetween, to provide an external configuration resembling conventional pallets.

U.S. Pat. No. 3,938,448 issued to Kiyoshi Nishitani et. al. on Feb. 17, 1976 describes a Plastic Pallet apparently formed of two identical mating halves or components. The components are permanently assembled, however, by welding or melting of the plastic to fuse them together. Consequently, no interlocking means is required, and none appears to be disclosed. The present pallet components may be disassembled from one another for replacement as required, and interlock to provide additional structural security. As in the pallets discussed above, the top and bottom sheets are unbroken and devoid of slots, holes, or other passages thereacross, whereas the present pallet includes a plurality of deck boards formed thereon with gaps between each.

U.S. Pat. No. 5,197,396 issued to Harlon W. Breezer et. al. on Mar. 30, 1993 describes a Double Deck Plastic Pallet comprising is similar upper and lower sheets which are bolted together. Each sheet is different, due to the need to capture the head of a T-bolt from one side and a mating nut from the opposite side, as well as the dissimilar ends of the posts assembled therebetween. No interlocking of the upper and lower components themselves is seen. The upper and lower sheets or components are each unbroken and devoid of passages, unlike the present pallet, and moreover include additional metal reinforcing structure therein, unlike the present pallet.

Finally, U.S. Pat. No. D-347,511 issued to Brandon L. Pigott et. al. on May 31, 1994 describes a Two part Interlocking Plastic Pallet Assembly comprising dissimilar top and bottom components. While it appears that both the upper and lower component include passages therethrough, they are relatively small and not like the gaps provided between closely spaced elongate deck boards, as in the present pallet. Pigott et. al. indicate some interlocking means, but none is disclosed in their patent '511. Moreover, the two pallet components are not identical insofar as their mating portions are concerned, as the side elevation views of FIGS. 4 and 5 show the apparent joints to be positioned asymmetrically between the two components, and a third spacing component inserted between the upper and lower components, unlike the present pallet.

None of the above noted patents, taken either singly or in combination, are seen to disclose the specific arrangement of concepts disclosed by the present invention.

SUMMARY OF THE INVENTION

By the present invention, an improved plastic pallet is disclosed.

Accordingly, one of the objects of the present invention is to provide an improved plastic pallet which is formed of upper and lower half components, which components are identical to one another and may be formed in a single mold, or in identical molds.

Another of the objects of the present invention is to provide an improved plastic pallet which component halves interlock with one another for added strength and security.

Yet another of the objects of the present invention is to provide an improved plastic pallet which half components may be disassembled from one another to provide for replacement of a damaged component.

Still another of the objects of the present invention is to provide an improved plastic pallet which includes fork lift slots in each of the four sides thereof, providing for lifting and carriage by a fork lift from any of four directions.

A further object of the present invention is to provide an improved plastic pallet which includes a cruciform central structure, for additional strength.

An additional object of the present invention is to provide an improved plastic pallet which includes a plurality of deck boards formed integrally therein, as well as tiedown slots formed therein and passing completely through each of the pallet components.

Another object of the present invention is to provide an improved plastic pallet which corners are rounded and devoid of sharp edges or protrusions.

Yet another object of the present invention is to provide an improved plastic pallet which may be formed of any practicable thermoplastic material, which may include recyclable plastics.

A final object of the present invention is to provide an improved plastic pallet for the purposes described which is inexpensive, dependable and fully effective in accomplishing its intended purpose.

With these and other objects in view which will more readily appear as the nature of the invention is better understood, the invention consists in the novel combination and arrangement of parts hereinafter more fully described, illustrated and claimed with reference being made to the attached drawings.

BRIEF DESCRIPTION OF THE DRAWINGS

Similar reference characters denote corresponding features consistently throughout tile several figures of the attached drawings.

DETAILED DESCRIPTION OF THE PREFERRED EMBODIMENTS

Figure 1:
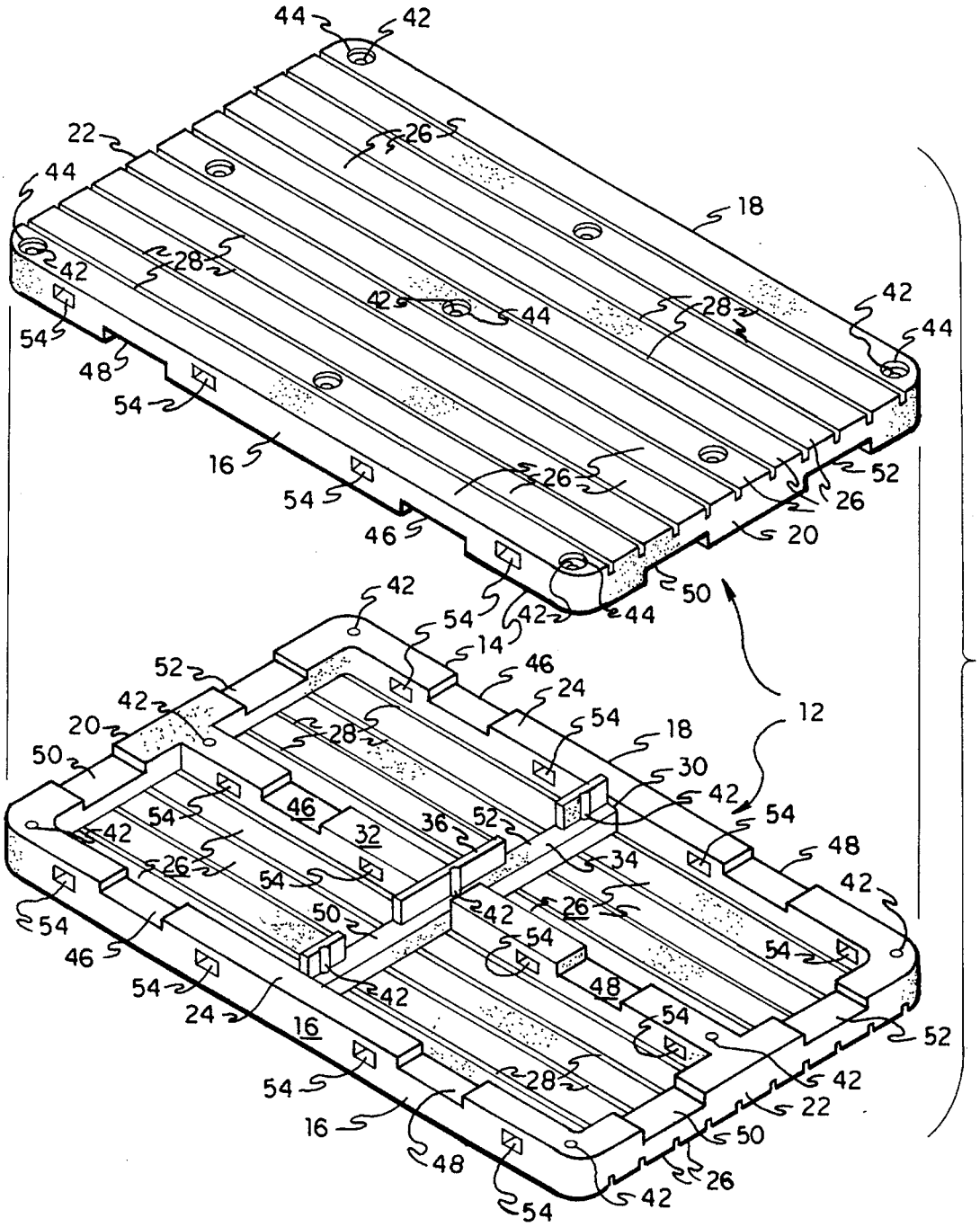
FIG. 1 is an exploded perspective view of a plastic pallet of the present invention, showing the outer structure of one pallet component and the inner structure of a second identical component.

Referring now particularly to FIG. 1 of the drawings the present invention will be seen to relate to a plastic pallet 10, shown separated into its two identical half components 12. Each half 12 is generally rectangular, with a peripheral member 14 extending therearound. The peripheral member 14 has four sides 16, 18, 20, and 22, and a flat surface 24 which defines a mating plane for the two halves 12 when they are joined together.

Each pallet half 12 includes a plurality of parallel, elongate deck boards 26 extending thereacross to form a surface opposite and parallel to that of the mating plane, with each being spaced apart from one another by a gap 28 therebetween. The deck boards 26 may extend either parallel to the major axis of the pallet halves 12, as shown, or may alternatively extend across the shorter span between the opposite sides 16 and 18 of the peripheral member 14. it will be noted that the opposite sides 16 and 18 of the peripheral member 14 are of equal width to the deck boards 26, and thus serve as peripheral deck boards in addition to their peripheral structural function.

Preferably, the present pallet halves 12 are formed with two orthogonally disposed crossmembers, with a first crossmember 30 extending across the shorter span of each of the rectangular pallet halves 12, between the two opposite longer side members 16 and 18. A second crossmember 32, perpendicular to the first crossmember 30, may be provided for additional strength. The crossmembers 30 and 32 are each preferably of equal width to the deck boards 26, thus allowing the upper surface of the crossmember which is parallel to the deck boards 26 (the second crossmember 32 of FIG. 1) to serve also as a central deck board.

One crossmember, e.g., the first crossmember 30 of FIG. 1, includes an elongate step, with one side 34 being depressed below the level of the mating surface 24 of the peripheral member 14, and the opposite side 36 being raised an equal amount above the surface 24 of the peripheral member 14. The break between the two levels or sides 34 and 36 is along the centerline of the central crossmemeber 30, and thus also of the pallet half 12. (These features are included in both of the identical halves 12 of FIG. 1, although they are only visible in the lower half.) This height differential between the raised portion 36 and the lowered portion 34 defines an elongate step across the width of the pallet half 12, and along the length of the first crossmember 30.

Figure 2:
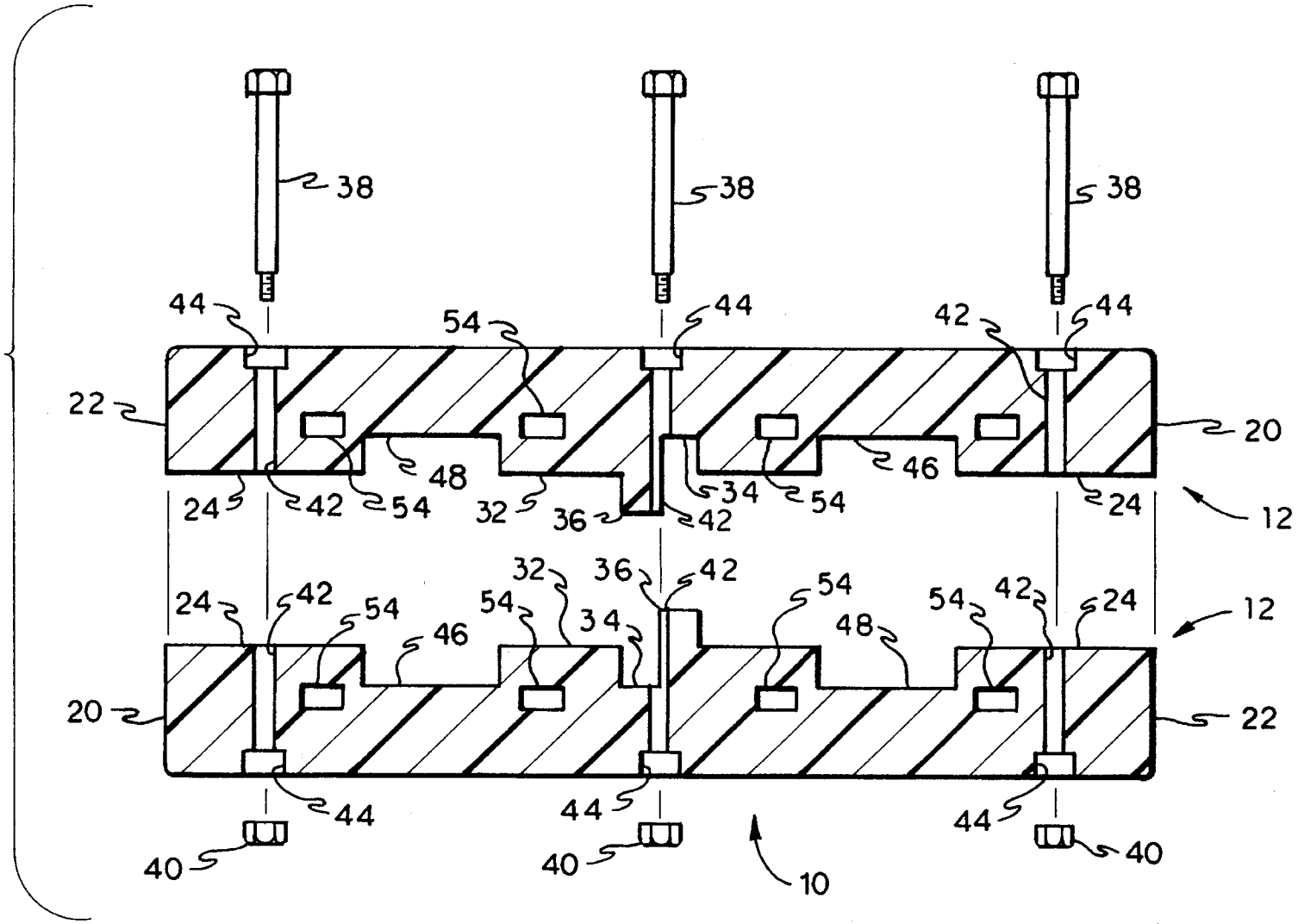
FIG. 2 is an exploded elevation view in section, showing the interlocking means and bolt assembly providing for securing the two components together.

FIG. 2 provides a cross sectional view of the mating of the two identical pallet halves 12 of FIG. 1. The halves 12 are joined by inverting one pallet half 12 relative to the other, so that their opposite ends 20 and 22 mutually overlie and underlie one another, with their mating surfaces 24 facing one another. This arrangement will be seen to place the raised side 36 of the stepped crossmember 30 of each of the halves 12, directly opposite the depressed side 34 of the opposite stepped crossmember 30 of the other pallet half 12. Thus, when the two halves 12 are mated together, the interlocking of the raised portions 36 with their corresponding depressed portions 34 of the central crossmember 30, precludes any lateral shifting of the two pallet halves 12 relative to one another. The ends of the stepped crossmember 30 are also captured within the opposite peripheral members 16 and 18, to preclude lateral movement parallel to the axis of the step.

The two halves 12 are held together by a plurality of Casteners (e. g., bolts 38 and mating nuts, preferably elastic insert lock nuts, 40) which clamp or compress the two halves 12 together. A corresponding plurality of fastener holes 42 are provided through the two halves, with the holes 42 being in registry with one another due to the identical nature of the two halves 12. Preferably, the holes 12 are provided with a larger diameter counterbore 44 in the outer or deck board surface of the pallet halves 12, in order for the bolt heads and nuts 40 to be recessed below the outer surface when the pallet 10 is in use, to preclude their catching or snagging on an underlying surface or on any articles placed on the pallet 10. While a total of nine bolt or fastener holes 42 are shown it will be understood that a greater or lesser number may be provided, as required.

The present pallet 10 is particularly adapted for handling by lurk lifts, and as such incorporates passages therethrough for the fork tines of a fork lift. These passages are formed by slots 46 and 48 through the opposite sides 16 and 18 of the peripheral member 14, and corresponding slots 46 and 48 through the second central crossmember 32 (if provided). Each of the slots 46 and 48 are respectively aligned with one another and due to the identical nature of the two pallet halves 12, are in registry with one another when the pallet halves 12 are assembled to form a completed pallet 10, to provide fork lift passages completely therethrough. In a similar manner, additional peripheral slots 50 and 52 may be provided through the shorter sides 20 and 22 of the peripheralmember 14, with corresponding aligned slots 50 and 52 through the first crossmember 30. Thus, the present pallet 10 may be lifted from any of its four sides 16 through 22 by a fork lift.

The present pallet 10 also provides for the tying down or securing of cargo or articles thereto, by means of a plurality of tiedown passages 54 formed in at least one direction across the width of each pallet half 12. These tiedown passages 54 extend through the opposite first and second sides 16 and 18, and the second central crossmember 32 therebetween and parallel thereto. A cardo strap or the like may thus be passed through the tiedown passages 54 as required, to secure cargo or articles tightly to the present pallet 10. Such passages (not shown) may be included through the other sides or edges 20 and 22 and the parallel first crossmember 30 of the pallet halves 12, if desired. (It will be noted that the present construction will provide duplicate tiedown passages 54 in both the upper and lower pallet half 12, due to their identical nature. Either the upper or lower set of tiedown passages 54 would be used in the assembled pallet 10.)

Figure 3:
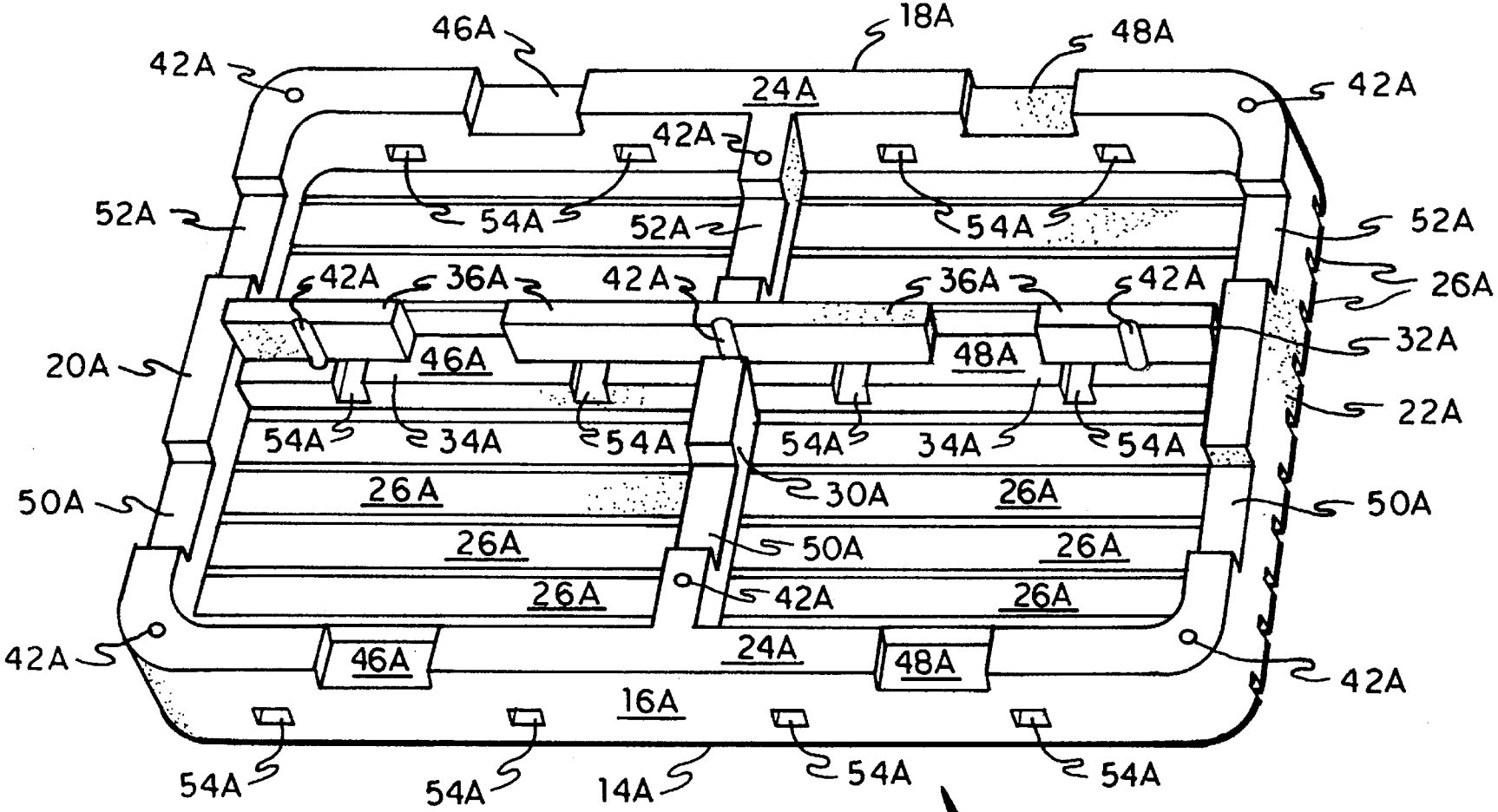
FIG. 3 is a perspective view of an alternative embodiment pallet component half of the present invention, showing alternative interlocking means perpendicular to that of the embodiments of FIGS. 1 and 2.

FIG. 3 discloses the interior of an alternative pallet half **12*a* of the present invention. Its structure is generally similar to that of the pallet halves 12 discussed in FIGS. 1 and 2 above, but the longer second crossmember 32*a* is stepped with a relatively lower side 34*a* and higher side 36*a*, disposed respectively below and above the plane of the mating surface 24*a* of the peripheral member 14*a*. The first crossmember 30*a* is not stepped in the embodiment of FIG. 3, but has a surface which is coplanar with the peripheral mating surface 24*a*. The remaining components (sides 16*a* through 22*a*, deck boards 26*a*, fastener holes 42*a*, fork lift slots 46*a* through 52*a*, and tiedown passages 54*a*) are identical to sides 16 through 22, deck boards 26, holes 42, fork lift slots 46 through 52, and tiedown passages 54 of the pallet halves 12 of FIGS. 1 and 2**, as applicable.

Due to the interlocking step being provided on the longer second crossmember **32*a* of the pallet half 12*a* of FIG. 3, the reversal of two halves 12*a* for assembly into a completed pallet is somewhat different than that described for the pallet 10 of FIG. 1. With the pallet halves 12 of FIG. 1, the upper half 12 was placed over the lower half 12 with the upper and lower first sides 16 in registry, and the upper and lower second sides 18 in registry. The upper third side 20 overlies the lower fourth side 22, and the lower third side 20 underlies the upper fourth side 22 in FIGS. 1 and 2. This arrangement allows the two stepped first crossmembers 30 to interlock with one another, as shown in FIGS. 1 and 2**.

With the longer crossmember **32*a* being stepped in the pallet embodiment of FIG. 3, two such pallet halves 12*a* would be assembled together with their opposite shorter sides 20*a* and 22*a* respectively being in overlying and underlying registry with one another, and one longer side 16*a* mating with the other longer side 18*a* of the second pallet half. The remaining longer sides 16*a* and 18*a* would thus also be in registry. The basic assembly principle is that the sides which are always in exact registry (e.g., sides 16 of the upper and lower halves 12, and sides 18 of the upper and lower halves 12, as shown in FIG. 1) are the sides which define the ends of the stepped crossmember (e. g., crossmember 30 in FIG. 1). It will be seen that only one—either crossmember 30 or 32, but not both—may be stepped, while maintaining the identical nature of the two pallet halves 12 (or the second embodiment 12*a***). It is possible to form steps in both crossmembers and provide mirror image halves, but those halves would not be identical and could not be formed in a single mold.

The above described pallet construction lends itself well to fabrication by casting or injection molding, using plastics or like materials. The entire structure of each half **12/12*a* is completely monolithic, with no additional components required, and in fact no other materials are used other than the plastic or other base material used to mold or form each half; they are completely homogeneous throughout, with no other reinforcing or other materials used or required. Preferably, plastics which provide a reasonably sturdy structure when molded in massive components such as the present pallet halves 12/12*a*, are used. Examples of such which may be used in the construction of the present pallet halves 12/12*a*** include polyethylene, polypropylene, polystyrene, acrylics, ABS (acrylonitrile butadiene styrene) and PVC (polyvinyl chloride). Other plastics and compounds with similar properties may be used, if desired.

The above plastics, as well as others, are generally recyclable, and may be melted down and reused in the formation of new pallet halves or for other plastic goods and materials. Thus, even in the event that a portion of the present pallet is damaged, it may still be reused by means of the recycling process. The construction of the present pallet from plastics also lends itself to the formation of smooth surfaces and rounded corners and edges, thus reducing the likelihood of cuts, splinters, and other minor injuries to persons handling the pallets. (It will be seen that the deck board edges may also be rounded if desired, in the manner of the corners of the pallet halves 12/12*a* illustrated in the drawing figures.) This will be seen to result in further economies of use with the present pallets, due to the reduction of medical expenses and lost time from work to attend to such injuries.

The durability of such plastic pallet components will result in relatively long lives for such components, likely several times what of conventional wood pallets and pallets formed from corrugated materials. While the initial expense of the present pallet may be somewhat higher than pallets of other materials, the savings in labor costs for assembly and the great durability and longevity of the present pallet will be seen to counter the slightly higher initial costs, if any. In the event that a pallet of the present construction is damaged, one need only remove the bolts securing the two halves together and reassemble a new or serviceable identical half to the original undamaged half. It is likely that an undamaged half portion would remain from other damaged pallets in a large warehouse or similar operation, and such an undamaged half could be used to provide a usable pallet, with no concern over mismatching due to their identical nature. In summary, the present plastic pallet invention offers numerous advantages in operational economy, as described above, which easily more than compensate for any slight increase in initial cost of manufacture.

It is to be understood that the present invention is not limited to the sole embodiments described above, but encompasses any and all embodiments within the scope of the following claims.

I claim:

1. A plastic pallet comprising:

a first pallet half and a second pallet half, with each said pallet half being identical to one another and being monolithically form med entirely of plastic material and devoid of other materials;

each said pallet half halving a substantially rectangular said peripheral member with a plurality of spaced apart deck boards extending thereacross and formed integrally therewith, with each said peripheral member having a flat surface defining a mating plane for each said pallet half when each said pallet half is joined together to form said pallet;

each said pallet half further including at least one stepped central crossmember extending across said peripheral member and formed integrally therewith, said crossmember being evenly divided lengthwise into a portion protruding above said mating plane of said peripheral member and a portion depressed below said mating plane of said peripheral member, thereby defining an elongate step extending across said peripheral member of each said pallet half, and, each said pallet half being placed together with each said mating plane of each said peripheral member in mating contact, with said protruding portion of said first pallet half crossmember mating with said depressed portion of said second pallet half crossmember and said protruding portion of said second pallet half crossmember mating with said depressed portion of said first pallet half crossmember to removably interlock each said pallet half together to form a completed pallet.

2. The plastic pallet of claim 1 wherein:

said peripheral member of each said pallet half includes two spaced apart depressions in each side thereof, with said depressions of each said pallet half being in registry when each said pallet half is assembled together to provide fork lift slots in each side of said pallet, and;

each said at least one central crossmember includes two spaced apart depressions aligned with opposed said spaced apart depressions of said peripheral member to provide continuous fork it passages completely through said pallet when each said pallet half is assembled together.

3. The plastic pallet of claim 1 wherein:

said at least one central crossmember is perpendicular to said deck boards.

4. The plastic pallet of claim 1 wherein:

said at least one central crossmember is parallel to said deck boards.

5. The plastic pallet of claim 1 wherein:

each said pallet half includes a first and a second central crossmember extending across said peripheral member, with said first and said second crossmember being perpendicular to one another to form a cruciform configuration, and said first crossmember further being perpendicular to said deck boards and being stepped to provide for interlocking of each said pallet half to form a completed pallet.

6. The plastic pallet of claim 1 wherein:

each said pallet half includes a first and a second central crossmember extending across said peripheral member, with said first and said second crossmember being perpendicular to one another to form a cruciform configuration, and said first crossmember further being parallel to said deck boards and being stepped to provide for interlocking of each said pallet half to form a completed pallet.

7. The plastic pallet of claim 1 wherein:

each said pallet half includes a first and a second central crossmember extending across said peripheral member, with said first and said second crossmember being perpendicular to one another to form a cruciform configuration, and;

each said crossmember includes two spaced apart depressions aligned with opposed spaced apart depressions formed in said peripheral member to provide continuous fork lift passages completely through said pallet when each said pallet half is assembled together.

8. The plastic pallet of claim 1 wherein:

each said pallet half includes tiedown passages therethrough, disposed in at least two opposite sides thereof and one said central crossmember therebetween.

9. The plastic pallet of claim 1 wherein:

each said pallet half includes a plurality of fastener holes therethrough, with each of said fastener holes including a depression therein providing clearance for a bolt head and nut.

10. The plastic pallet of claim i wherein:

said plastic material from which each said pallet half is formed is selected from the group consisting of polyethylene, polypropylene, polystyrene, acrylic, acrylonitrile butadiene styrene, and polyvinyl chloride.

11. A plastic pallet component comprising:

a pallet half monolithically formed entirely of plastic material and devoid of other materials;

said pallet half having a substantially rectangular peripheral member with a plurality of spaced apart deck boards extending thereacross and formed integrally therewith, with said. perpheral member having a flat surface defining a mating plane for said pallet half;

said pallet half further including at least one stepped central crossmember extending across said peripheral member and formed integrally therewith, said crossmember being evenly divided lengthwise into a portion protruding above said mating plane of said peripheral member and a portion depressed below said mating plane of said peripheral member, thereby defining an elongate step extending across said peripheral member of said pallet half, whereby;

said pallet half is adapted to be placed together with another said pallet half of identical configuration, with said elongate step of said peripheral member of said pallet half interlocking with said another said pallet half of identical configuration to provide a completed pallet assembly.

12. The plastic pallet component of claim 11 wherein:

said peripheral member of said pallet half includes two spaced apart depressions in each side thereof to provide fork lift slots in each side of said pallet component, and;

said at least one central crossmember includes two spaced apart depressions aligned with opposed said spaced apart depresssion of said peripheral member to provide continuous fork lift passages completely across said pallet component.

13. The plastic pallet component of claim 1, wherein:

said at least one central crossmember is perpendicular to said deck boards.

14. The plastic pallet component of claim 11 wherein:

said at least one central crossmember is parallel to said deck boards.

15. The plastic pallet component of claim 11 wherein:

said pallet half includes a first and a second central crossmember extending across said peripheral member, with said first and said second crossmember being perpendicular to one another to form a cruciform configuration, and said first crossmember further being perpendicular to said deck boards and being stepped to provide interlocking means, whereby;

one said pallet half is interlocked with another said pallet half to form a completed pallet.

16. The plastic pallet component of claim 1i wherein:

said pallet half includes a first and a second central crossmember extending across said peripheral member, with said first and said second crossmember being perpendicular to one another to form a cruciform configuration, and said first crossmember further being parallel to said deck boards and being stepped to provide interlocking means, whereby;

one said pallet half is interlocked with another said pallet half to form a completed pallet.

17. The plastic pallet component of claim 11 wherein:

said pallet half includes a first and a second central crossmember extending across said peripheral member, with said first and said second crossmember being perpendicular to one another to form a cruciform configuration, and;

each said crossmember includes two spaced apart depressions aligned with opposed spaced apart depressions formed in said peripheral member to provide continuous fork lift passages completely across said pallet component.

18. The plastic pallet component oil claim 11 wherein:

said pallet half includes tiedown passages therethrough, disposed in at least two opposite sides thereof and one said central crossmember therebetween.

19. The plastic pallet component of claim 11 wherein:

said pallet half includes a plurality of fastener holes therethrough, with each of said fastener holes including a depression therein providing clearance for a bolt head and nut.

20. The plastic pallet component of claim 11 wherein:

said plastic material from which said pallet half is formed is selected from the group consisting of polyethylene, polypropylene, polystyrene, acrylic, acrylonitrile butadiene styrene, and polyvinyl chloride.

* * * * *